US005927507A

United States Patent [19]

Shelton

[11] Patent Number: 5,927,507

[45] Date of Patent: Jul. 27, 1999

[54] REPLACEMENT BAND DISPLAY CONTAINER

[75] Inventor: Robert N. Shelton, Princeton, Mass.

[73] Assignee: Genal Strap, Inc., Long Island City, N.Y.

[21] Appl. No.: 09/066,983

[22] Filed: Apr. 24, 1998

[51] Int. Cl.[6] ..... B65D 85/40; B65D 41/18

[52] U.S. Cl. ..... 206/776; 206/301; 206/468; 220/345.3

[58] Field of Search ..... 206/301, 18, 70, 206/461, 468, 559, 560, 591, 775, 776; 220/345.1, 345.2–345.3, 345.4, 350, 351

[56] References Cited

U.S. PATENT DOCUMENTS

| | | | |
|---|---|---|---|
| 938,964 | 11/1909 | Brown | 206/560 |
| 1,615,324 | 1/1927 | Bulova | 206/560 |
| 3,182,790 | 5/1965 | Bieganousky et al. | 206/591 |
| 3,217,867 | 11/1965 | Harris | 206/468 |
| 3,365,056 | 1/1968 | Mandel | 206/301 |
| 3,918,577 | 11/1975 | Horzick | 206/301 |
| 4,830,181 | 5/1989 | Hartman | 206/301 |
| 4,940,143 | 7/1990 | Stanfield | 206/560 |
| 5,358,134 | 10/1994 | Ripley et al. | 206/301 |
| 5,685,430 | 11/1997 | Weisburn et al. | 206/455 |

OTHER PUBLICATIONS

Specimen of prior art plastic case (JB).
Specimen of prior art paper container (SNAPPY).
Specimen of prior art plastic case with protrusion, tabs and rigid retaining elements (LINEA).

*Primary Examiner*—Paul T. Sewell
*Assistant Examiner*—Luan K. Bui
*Attorney, Agent, or Firm*—Robert L. Epstein, Esq.; Harold James, Esq.; James & Franklin, LLP

[57] ABSTRACT

Top and bottom transparent plastic parts with oppositely inclined side edges slide together to form a box-like enclosure. The top part has a slot at the upper end. The bottom part has a protrusion at its upper end which is received in the slot as the parts slide toward each other. The protrusion has an opening to receive a rod from a display rack. Tabs and tab receiving recesses positively but releasably engage the lower ends of the parts. Upstanding elements with inclined surfaces on the top part cooperate with the tabs on the bottom part to flex the top part as the tabs are received in the recesses and maintain the tabs in the recesses to prevent accidental dislodgement. The tabs are released from the recesses by depressing the top part such that the tabs clear the upstanding elements as the parts slide apart. Resilient elements extending from the side walls of the bottom part retain the band in a position centered within the enclosure.

12 Claims, 4 Drawing Sheets

REPLACEMENT BAND DISPLAY CONTAINER

The present invention relates to replacement bands or straps for wrist watches and more particularly to a transparent container in which such a band can be packaged for sale and displayed, which releasably latches to prevent accidental opening and is capable of accommodating any of a large variety of different size bands in a manner which secures the band against movement within the container.

Watch bands or straps of leather, metal and other materials are sold in a large variety of different sizes and styles as replacements for use on wrist watches. Leather bands commonly have two parts, one of which is adapted to be affixed to each side of the watch case, with a buckle or other clasp on one part to releasably secure it to the other part so as to surround the wrist of the wearer. Metal bands are usually formed of single part, which is expandable in some manner. The band is designed to be secured at either end to the watch case.

When sold, the band parts of the two part bands must be held together. This could be done by simply using a paper or rubber band to encircle the band parts, for example. However, since the manner in which the replacement bands are displayed is very important to the sale, it is very desireable to present the bands to the consumer in an asthetically pleasing manner.

It may also be important to organize the bands by size, style and/or color. One way this is accomplished is by suspending the bands from the rods of a display rack. For this reason, containers are often provided with openings to receive a rod.

Bands are commonly provided on a card or packaged in an enclosure. The enclosure may be made of a paper product, such as thin cardboard, and have a clear flexible plastic window so the band is visible.

However, the paper containers do not protect the bands very well during shipping and handling. Moreover, they require some additional element to hold the band to prevent it from shifting around within the container. Accordingly, the plastic type containers are preferred.

Transparent box-like enclosures made of two rigid rectangular plastic parts have also been used extensively. In one design, the container parts are held together by friction only, with the top part being slightly larger and fitting over the bottom part. Another approach has been to use interengaging tabs and tab receiving recesses which engage to keep the plastic parts together. In this type container, the top part is box-like, without a rear wall. The bottom part forms the rear wall of the container as the top part fits over the bottom part. Upstanding spaced rigid retaining parts are often employed to hold the band in the center of the bottom part.

Both types of conventional plastic containers have their drawbacks. Since the plastic enclosures are opened repeatedly by customers as the customers decide whether to purchase the band, the container must be easy to open. However, the prior art plastic containers are not always easy for the customer to open. On the other hand, if the container opens too easily, it may open accidentially when handled roughly or dropped. This is the case with the known containers. Thus, the prior art plastic containers are both too difficult for the customer to open and at the same time may open accidentally if mishandled.

Because the prior art containers must fit the band snuggly or hold the band tightly between the rigid retaining parts to avoid band movement, they must be supplied in many different sizes to accomodate many different size and style bands. This creates a great inventory problem for the supplier.

It is, therefore, a prime object of the present invention to provide a replacement band display container formed of rigid plastic parts which positively but releaseably latch together to permit easy opening for the customer but prevent accidental opening by rough handling or dropping.

It is another object of the present invention to provide a replacement band display container which can accomodate a wide variety of different size and style watch bands.

It is another object of the present invention to provide a band display container with resilient band retaining elements.

In accordance with one aspect of the present invention, a display container is provided. The container includes first and second parts which form a box-like enclosure. The first part includes a slot. The second part includes a protrusion adapted to be received within the slot. Interengaging means on the parts cooperate to retain the parts together, with the protrusion in the slot.

The container is adapted to be suspended from a rod of a display rack. The protrusion has rod engaging means in the form of an opening.

The interengaging means include tab means on the second part and tab receiving means on the first part. The interengaging means are spaced from the protrusion and slot.

The second part includes first and second spaced side walls. The tab means includes first and second coplanar tabs, extending from the first and second side walls, respectively. The tabs extend inwardly, toward each other.

The first part includes a front wall. The tab receiving means includes first and second tab receiving recesses located on the front wall. The recesses are adapted to receive the first and second tabs, respectively.

The interengaging parts further include means adapted to cooperate with the tab means to maintain the tab means in the tab receiving means. The maintaining means cooperates with the tab means as the tab means is received in the tab receiving means.

The maintaining means includes a generally triangular element with an inclined surface. Preferrably, it includes first and second upstanding elements, each with an inclined surface.

Resilient means are provided for retaining a band within the container. These means include first and second spaced resilient elements.

The second part includes first and second spaced side walls. Means are provided for affixing the first and second resilient elements to the first and second side walls, respectively.

Each of the resilient elements includes an arcuate portion.

The parts have side walls with oppositely inclined edges. As the parts slide together, along these edges, the protrusion on the second part is received in the slot in the first part. The inclined surfaces of the stop elements cooperate with the tab means to flex the front wall of the first part such that the tab means are received within the tab receiving recesses. The upstanding elements maintain the tab means in the tab receiving recesses.

To disengage the parts, the front wall of the first part is pressed inwardly such that the tab means clear the upstanding elements. The parts can then slide apart, the protrusion withdrawing from the slot.

In one preferred embodiment, the container includes an enlarged compartment. This enables bands of single part metal type to be supplied in the same length enclosure as leather two part bands.

To these and to such other objects which may hereinafter appear, the present invention relates to a replacement band display container as set forth in detail in the following specification and recited in the annexed claims, taken together with the accompanying drawings, wherein like numerals refer to like parts and in which:

Figure 1:
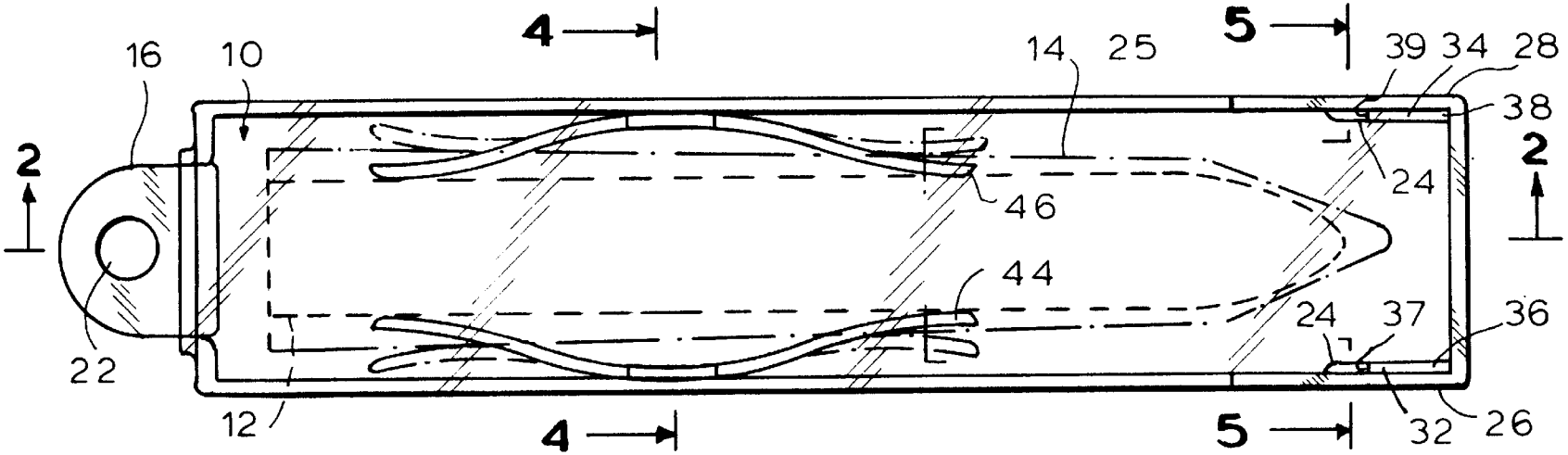
FIG. 1 is a top plan view of the container of the present invention.
Figure 3:
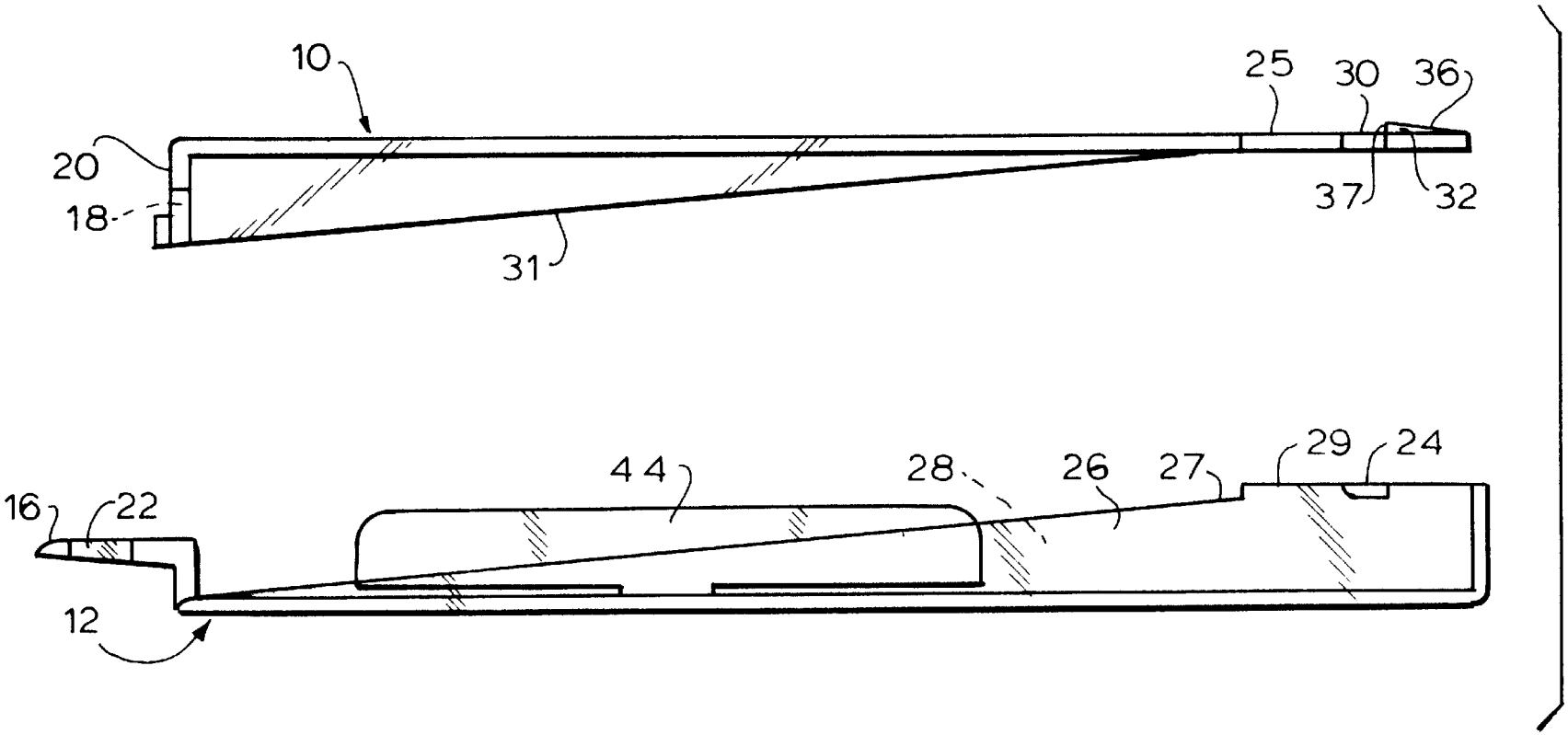
Figure 8:
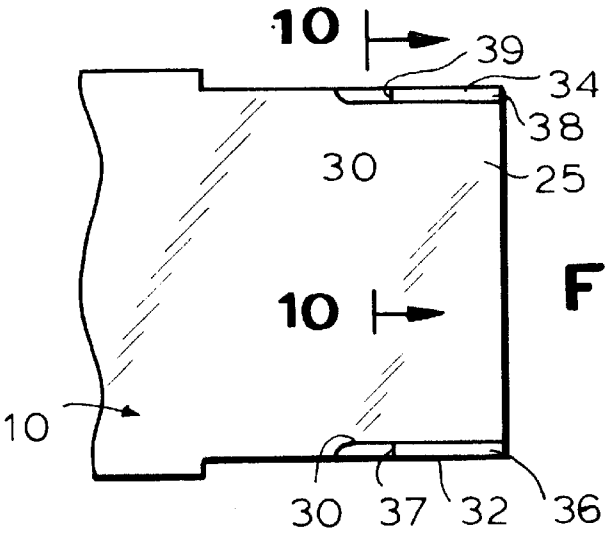
Figure 9:
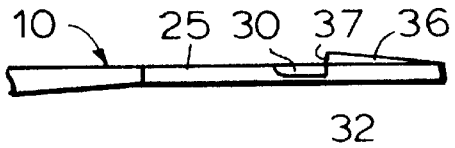
Figure 10:
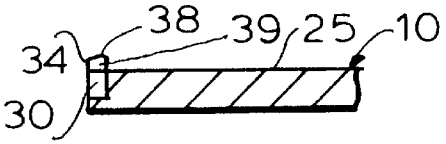
Figure 4:
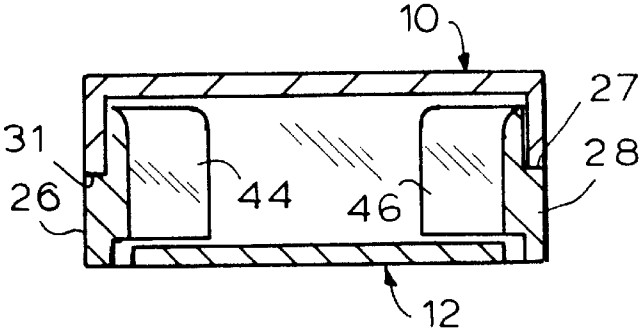
Figure 5:
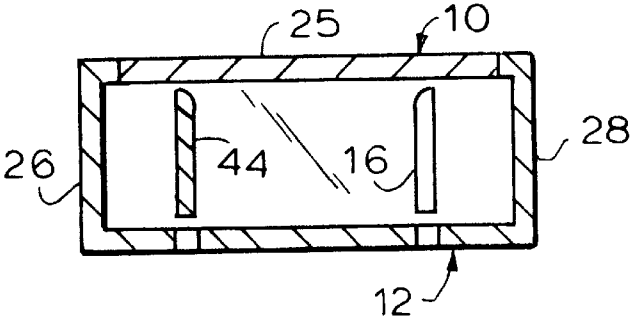
Figure 6:
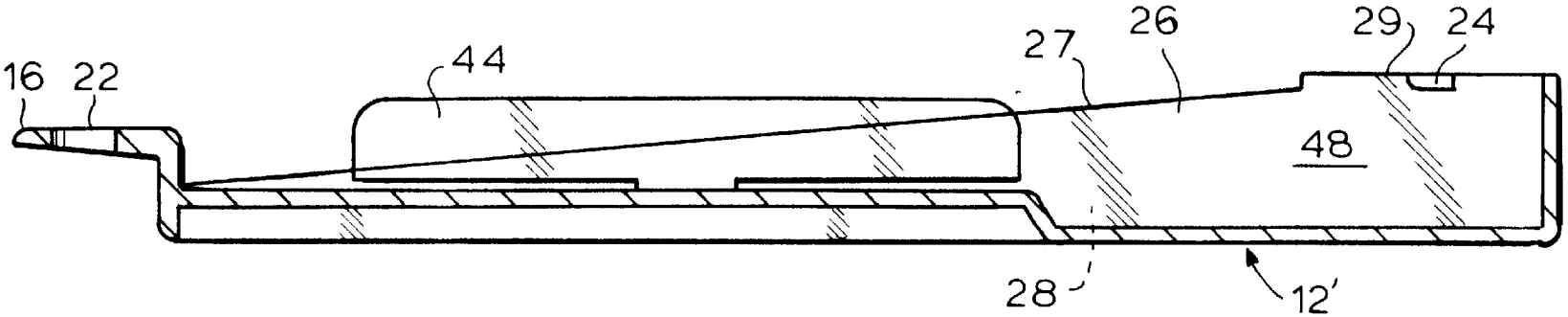
Figure 7:
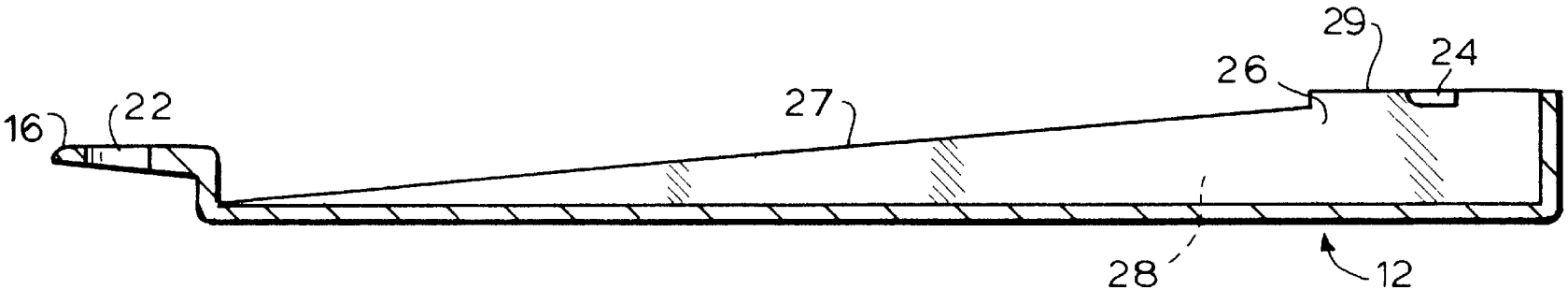

FIG. 3 an exploded side plan view of the container parts;

FIG. 4 is a cross-sectional view taken along line 4—4 of FIG. 1;

FIG. 5 is a cross-sectional view taken along line 5—5 of FIG. 1;

FIG. 6 is a side elevational view of a second preferred embodiment of the bottom part;

FIG. 7 is a side elevational view of a bottom part without band retaining elements;

FIG. 8 is an enlarged top elevational view of the lower portion of the top part;

FIG. 9 is a side elevational view of the portion of the top part shown in FIG. 8; and FIG. 10 is a cross-sectional view taken along line 10—10 of FIG. 8.

Figure 2:
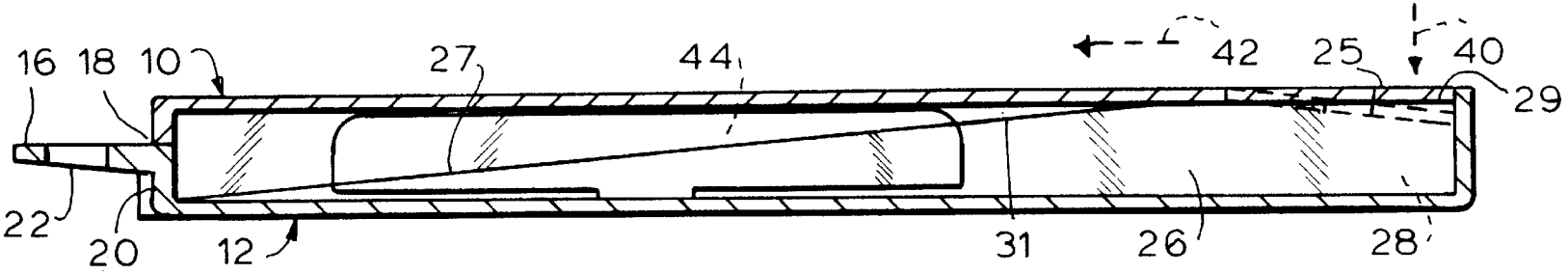
FIG. 2 is a side cross-sectional view taken along line 2—2 of FIG. 1.

As best seen in FIGS. 1, 2 and 3, the first preferred embodiment of the present invention comprises a top part 10 and a bottom part 12, both fabricated of medium impact transparent styrene. Parts 10 and 12 assemble to form a box-like enclosure for a replacement watch band or strap 14.

Each part 10, 12 has an upper end (left as seen in the drawings) adapted to be suspended from the rod of a display rack and a lower end (right as seen in the drawings). The upper ends of the parts engage through the cooperation of a generally semicircular protrusion 16 extending from the upper end of bottom part 12 which is received in a slot 18 in the end wall 20 of top part 10. Protrusion 16 has an opening or other means adapted to receive a rod of a display rack.

As protrusion 16 is received in slot 18 by sliding top part 10 in a generally parallel direction towards to bottom part 12, the lower portions of the parts latch to maintain the parts together. The latch mechanism includes a pair of inwardly directly coplanar tabs 24 mounted on the top edges of the side walls 26, 28 of the bottom part, respectively, and a pair of tab receiving recesses 30 on opposite sides of the exterior surface of the lower front wall 25 of top part 10 (see FIGS. 8 and 9).

Each side wall 26, 28 of bottom part 12 has an upper edge 27. The upper portion of each upper edge 27 is inclined relative to the rear wall of bottom part 12. A second portion 29 (at the lower portion) of edge 27 is generally parallel to the rear wall of bottom part 12. The side walls of top part 10 are oppositely inclined at edge 31 so as to mate with walls 26, 28 of the bottom part 12. Front wall 25 of top part 10 has no side walls.

Upstanding elements 32, 34 are provided. They are generally triangular in shape and have inclined top surfaces 36, 38 which cooperate with tabs 24 to flex front wall 25 of the top part out of its normal plane (coplanar with the rest of the surface of top part 10) such that tabs 24 can be received in recesses 30, as the top and bottom parts slide together. When the tabs 24 are received in recesses 30, the parts are positively latched together and will not accidentally dislodge because the vertical side surfaces 37, 39 of elements 32, 34 act to increase the effect depth of the recesses 30 substantially. Thus, tabs 24 are held securely in recesses 30.

However, the container is easily opened by the customer. In order to open the container, a small downward force is exerted by the finger on the front wall 25 of top part 10 in the direction shown by arrow 40 in FIG. 2 such that the wall 25 "flexes" as shown in phantom. Tabs 24 can now clear side walls 37, 39 of elements 32, 34 as the top part 10 slides away from the bottom part 12 in the direction of arrow 42 of FIG. 2. Once the tabs clear the upstanding elements, the top part 10 can be moved relative to the bottom part 12 so that protrusion 16 is withdrawn from slot 18 and the parts separate to provide access to the band.

To hold band 14 securely at the center of the container, a pair of oppositely oriented arcuate resilient retaining members 44, 46 are provided. Members 44, 46 are made of resilient plastic and are affixed to the interior surfaces of side walls 26, 28, respectively. The resilient nature of members 44, 46 permits them to "clamp" bands of a large variety of different widths therebetween. A single container can thus accommodate a large number of different band sizes and styles.

Most standard length, two part bands will fit into the first preferred embodiment of the container. However, some single part metal bands may be too long. Accordingly, a second preferred embodiment is provided. The second preferred embodiment is structurally the same as the first embodiment except that it has a bottom part 12' of increased depth, which forms an enlarged compartment 48 at the lower end, as shown in FIG. 6. The enlarged compartment 48 permits the band to be folded over itself so that single part metal bands can be accommodated without changing the overall length of the container.

As illustrated in FIG. 7, the container may be utilized without the retaining members 44, 46, if desired.

It should now be appreciated that the replacement band display container of the present invention includes a mechanism to latch the parts positively and releaseably together to permit easy opening by the customer but prevent accidental opening of the container by rough handling or dropping. The container can accommodate a wide variety of different size bands, eliminating the inventory problems associated with providing a large number of different size containers. The bands are securely retained against movement within the container by resilient retaining members.

The container of the present invention is simple in structure. It is fabricated of inexpensive plastic parts which cooperate reliably to produce an asthetically pleasing and functionally superior display enclosure.

While only a limited number of preferred embodiments have been disclosed for purposes of illustration, it is obvious that many variations and modifications could be made thereto. It is intended to cover all of these variations and modifications which fall within the scope of the invention, as defined by the following claims:

I claim:

1. A display container comprising first and second parts adapted to assemble to form an enclosure, said first part comprising an end wall having a slot, a front wall, an element situated on and extending above the surface of said front wall and having an inclined surface, said second part comprising an end wall with a protrusion adapted to be received in said slot, a side wall and a tab situated on and extending from said side wall in a direction substantially perpendicular to said side wall, adapted to cooperate with said element, as said parts are moved relative to each other, such that said protrusion is received within said slot and said tab moves along said inclined surface of said element, over said element, latching said parts together.

2. The container of claim 1 further comprising a recess in said front wall, adjacent said element, adapted to receive said tab.

3. The container of claim 1 wherein said element is substantially triangular in shape.

4. The container of claim 1 further comprising a second element situated on and extending above said surface of said front wall, at a location spaced from said element.

5. The container of claim 1 wherein said second part has a second side wall and further comprising a second tab situated on said second side wall, substantially coplanar with said tab.

6. The container of claim 5 further comprising a second recess in said front wall, said second recess being adapted to receive said second tab.

7. The container of claim 1 wherein said front wall flexes to enable said tab to pass over said element, to permit said parts to be unlatched.

8. The container of claim 1 further comprising an opening in said protrusion adapted to receive the rod of a display rack.

9. The container of claim 1 wherein each of said parts comprises a side wall with a section having an inclined edge and wherein said side wall section edges are oppositely inclined.

10. The container of claim 1 wherein said second part has a second side wall and further comprising first and second spaced members mounted on said side walls, respectively, each of said members having a resilient portion extending generally in the direction of said side wall to which it is mounted, said resilient portions being adapted to secure an article therebetween.

11. The container of claim 10 wherein said resilient portions are arcuate.

12. The container of claim 1 wherein one of said parts comprises a wall with a section of increased depth.

* * * * *